United States Patent [19]

Noguchi et al.

[11] 3,996,910

[45] Dec. 14, 1976

[54] FUEL INJECTION SYSTEM FOR INTERNAL COMBUSTION ENGINE

[75] Inventors: Masaaki Noguchi, Nagoya; Yukiyasu Tanaka, Okazaki; Taro Tanaka, Chiryu, all of Japan

[73] Assignee: Nippon Soken, Inc., Nishio, Japan

[22] Filed: July 17, 1975

[21] Appl. No.: 596,744

[30] Foreign Application Priority Data

July 29, 1974 Japan ..... 49-86776
Nov. 29, 1974 Japan ..... 49-137121

[52] U.S. Cl. ..... 123/139 AW; 123/139 BC
[51] Int. Cl.[2] ..... F02M 39/00
[58] Field of Search ..... 123/139 AW, 139 BC, 123/140 MP

[56] References Cited

UNITED STATES PATENTS 2,955,583 10/1960 Dahl ..... 123/139 BC
3,680,535 8/1972 Eckert ..... 123/139 AW

*Primary Examiner*—Robert G. Nilson
*Attorney, Agent, or Firm*—Cushman, Darby & Cushman

[57] ABSTRACT

A fuel injection system for internal combustion engines comprising a sensor for detecting the intake air flow rate, a device for metering the fuel in association with the sensor, a fuel delivery device for delivering the fuel to be metered by the device, and fuel injection nozzles for injecting the fuel delivered from the fuel metering device into the cylinders or an intake manifold of the engine. The housing of the fuel metering device includes fuel outlets communicated with the fuel injection nozzles, respectively, a fuel inlet communicated with the fuel delivery device, a rotor which is rotated in synchronism with the operation of the engine, and a control shaft which is displaced relative to the rotor depending upon the intake air flow rate detected. In one preferred embodiment of the present invention, the control shaft is provided with a plurality of radial communication slits which are circumferentially equiangularly spaced apart with each other and are formed through the tubular wall of the control shaft, the inner opening of each of the communication slits being opened into a fuel passage formed within the control shaft and communicated with the fuel inlet, and the outer opening being opened at the outer peripheral surface of the control shaft. The rotor is provided with a fuel distribution slot formed through the tubular wall thereof for communication with the fuel outlets, said fuel distribution slot being sequentially communicated with each of the communication slits of the control-shaft which is axially slidably fitted into the cylindrical bore in the rotor. As the rotor is rotated, the fuel distribution slot thereof sequentially overlaps with the communication slits of the control shaft so that the metered fuel may be sequentially delivered to the outlets. The control shaft is operatively coupled to the sensor so that the former may be axially displaced relative to the rotor in response to the intake air flow rate. Therefore, the overlap area between the distribution slit and the communication slits changes in response to the intake air flow so that the quantity of fuel to be delivered to the fuel injection valves are controlled in the optimum manner in response to the intake air flow rate.

14 Claims, 16 Drawing Figures

FUEL INJECTION SYSTEM FOR INTERNAL COMBUSTION ENGINE

The present invention relates to a fuel injection system for internal combustion engines.

Various fuel injection systems have been proposed and demonstrated. One type is provided with a device for controlling the fuel quantity in response to the intake air quantity (to be referred to as the intake air flow rate in this specification). The fuel quantity control device, for instance, comprises a variable orifice inserted within a fuel passage and operatively coupled to an intake air flow rate sensor, and means for maintaining the pressure difference across the variable orifice constant, whereby the flow rate of the fuel flowing through the fuel passage may be controlled by the variable orifice in response to the intake air flow rate. There has been also known the fuel injection system of the type in which thy fuel quantity is controlled by a Jerk type fuel injection pump provided with a control roller in the form of a solid cam which is actuated in response to the rotational speed of the engine and to the opening degree of a throttle valve, the fuel being intermittently injected into the cylinders by the fuel injection valves or nozzles.

In the former fuel injection system, the fuel is continuously delivered to the fuel injection valves during the operation of the engine. It is well known that when the opening of the intake valve is overlapped with the opening of the exhaust valve, the unburned fuel is discharged through the exhaust port so that the HC content in the exhaust gases is increased. Furthermore, one variable orifice is provided for each cylinder and means for maintaining the pressure difference across the vairable orifice constant is provided. As a result, the fuel injection system is very complex in construction, the structural parts must be produced with severe manufacture tolerances, and the assembly must be accurately adjusted so that the uniform distribution of fuel into each of the cylinders may be ensured. The fuel injection system employing the Jerk type fuel injection pumps has an advantage that the fuel is injected under a high pressure so that the fuel may be satisfactorily atomized. Air-fuel ratio for internal combustion engine is preferably controlled directly in response to intake air flow rate. However, in such system the fuel quantity injected to the engine is controlled in response to the rotational speed of the engine and the opening degree of the throttle valve, but it is not directly controlled in response to the intake air flow rate. As the result, the air-flow ratio cannot easily be adjusted in high accuracy, in the engine having such a system, due to the manufacturing dispersion in the mechanically connected parts and the wears of the engine parts which cause the air-fuel ratio to vary. When the Jerk type fuel injection pump is used in the multicylinder engine, the elements equal in number to the cylinders must be used. As a result, the construction is complex, and the structural parts must be finished with a higher accuracy, resulting in increase in manufacturing cost. Furthermore, the Jerk type fuel injection pumps are bulky and heavy so that there arises an installation space problem.

In view of the above, one of the objects of the present invention is to provide a fuel injection system for internal combustion engines which may substantially overcome the above and other problems encountered in the conventional fuel injection systems, and which is simple in construction yet capable of intermittently injecting into the cylinders the fuel, the quantity of which is metered with a higher accuracy in response to the intake air flow rate.

For this purpose, the present invention provides a fuel metering device comprising a housing provided with fuel outlet ports equal in number to the cylinders of an engine, a control shaft fitted in the housing for axial displacement in response to the intake air flow rate, and a rotor fitted into the housing for rotation in synchronism with the operation of the engine, the control shaft being provided with an annular groove and the rotor being provided with a fuel distribution slot so that the fuel to be metered may be continuously controlled by the overlapped portion between the annular groove and fuel distribution slot, and the metered fuel being delivered to each fuel outlet port when the fuel distribution slot coincides with the outlet port.

Figure 14:
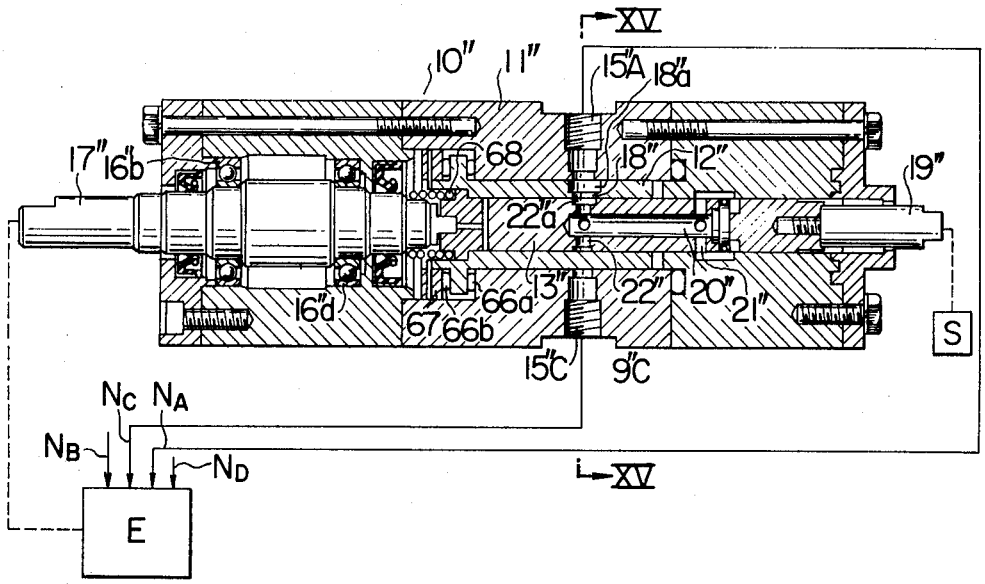
FIG. 14 is a sectional view of a sixth embodiment of the present invention.
Figure 16:
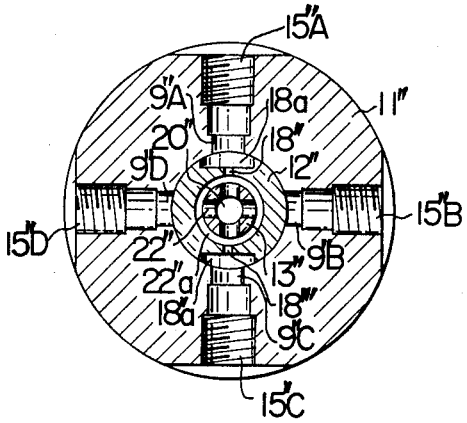

FIG. 16. is a view similar to FIG. 14 and illustrating a variation of the sixth embodiment.

Same reference numerals with or without prime, are used to denote similar parts throughout the figures.

The present invention will be described in detail hereinafter as being applied to a four-cylinder internal combustion engine.

FIRST EMBODIMENT, FIGS. 1 THROUGH 4

Referring to FIGS. 1 through 4, the first embodiment of the present invention will be described. Reference numeral 1 denotes a four-cylinder internal combustion engine; 2, an intake air duct; 3, an intake air flow rate sensor 3 of the conventional type which is disposed within the intake air duct 2 and swingable about a pivot pin 3*a* depending upon the intake air flow rate; 4, a fuel tank; 56, a device for delivering the fuel under pressure to be referred to as the "pressurized fuel delivery device" in this specification, which device 56 comprises a fuel pump 5 and a pressure control device 6 for controlling the pressure of the fuel flowing thorough a fuel line 7 at a constant level (generally 2 to 10 atm.); and 8, a fuel injection valve provided for each of the four cylinders of the engine 1 for injecting the fuel into the cylinder or an intake manifold.

Figure 1:
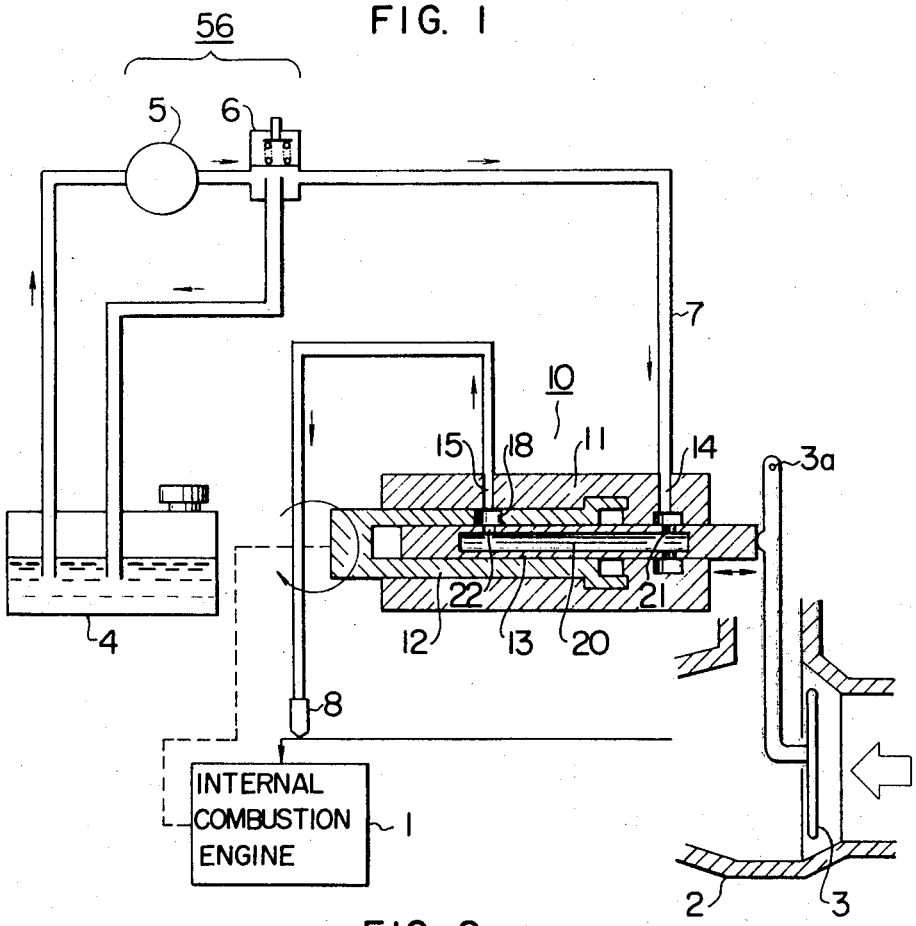
FIG. 1 is a schematic view of a first embodiment of a fuel injection system in accordance with the present invention.
Figure 2:
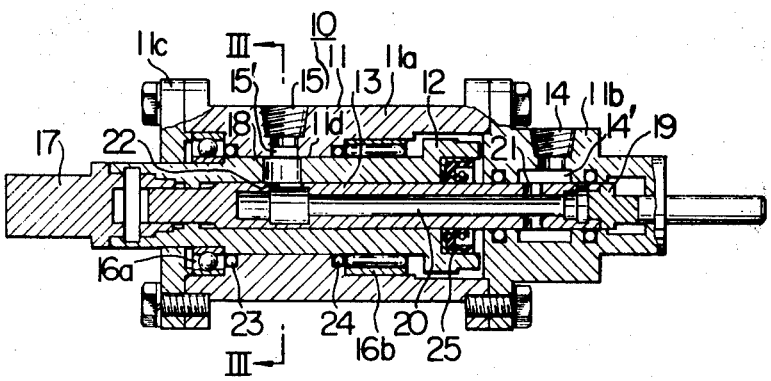
FIG. 2 is a sectional view taken along the line II—II of FIG. 3 of a fuel metering and delivery device thereof.
Figure 3:
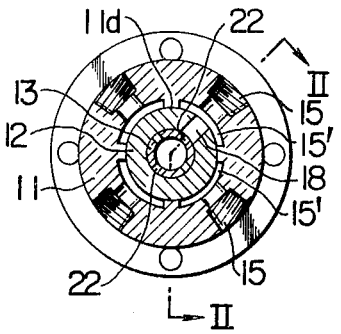
FIG. 3 is a sectional view taken along the line III—III of FIG. 2.

Referring to FIGS. 1, 2 and 3, a fuel metering delivery device generally indicated by the reference numeral 10 comprises, in general, a housing 11, a cylinder-shaped rotor 12 rotatably fitted into the cylinder bore 11*d* in the housing 11, and a control shaft 13 axially slidably fitted into the housing 11 and the rotor 12. As best shown in FIG. 2, the housing 11 is made up of a main section 11*a* and a right and left cover sections 11*b* and 11*c* which are joined to the main section 11*a* with bolts. The right cover section 11*b* provided with a fuel inlet 14 extended radially, and the main body section 11*a* is provided with four fuel outlets 15 which are extended radially and equiangularly spaced apart from each other at the same axial position; that is, on the same plane perpendicular to the axis of the housing 11 as best shown in FIG. 3. The fuel inlet 14 is communicated with an annular groove 14' formed within the right cover section 11*b* and the fuel outlets 15 are communicated with arcuate grooves 15' with an arc angle of 30° to 80°. The fuel line 7 is communicated with the fuel inlet 14, and the fuel outlets 15 are communicated through the fuel lines with the fuel injection valve 8.

The rotor 12 which is rotatably supported by two bearings 16*a* and 16*b* within the housing 11 has its left end portion which extends out of the housing 11 and is connected through a shaft member or rod 17 with the engine 1 so that the rotor 12 may be rotated in synchronism with the rotation of the engine 1. More particularly, the rotor 12 is drivingly connected through a suitable mechanism to the crankshaft (not shown) of the engine 1 in such a way that the rotor 12 makes one rotation for every one cycle of the engine. The rotor 12 is provided with a radial fuel distribution slot 18 for sequential communication with the fuel outlets 15. The control shaft 13 is so arranged that it is not permitted to rotate with the rotor 12 but is slidable only in the axial direction. The right end of the control shaft 13 extended out of the housing 11 is operatively coupled through a connecting member 19 to the intake air flow rate sensor 3 as best shown in FIG. 1 so that the control member 13 may be displaced in response to the deflection or swinging motion of the sensor 3; that is, in resonse to the intake air flow rate. The control member 13 is provided with a fuel passage 20 which extends axially and is communicated through a radial hole 21 with the annular groove 14 which is in communication with the fuel inlet 14. The fuel passage 20 is also communicated with the fuel distribution slit 18 through one of four radial communication slit 22 formed through the side wall of the control member 13 in equiangularly spaced apart relation. The circumferential angular width of the communication slit 22 of the control member 13 is smaller than that of the fuel distribution slot 18 of the rotor 12. When the rotor 12 is rotated, the distribution slot 18 is sequentially communicated with the communication slits 22 of the control shaft 13, but the area where the radial slit 22 and the distribution slot 18 overlap with each other, changes depending upon the axial displacement of the control member 13.

Reference numerals 23, 24 and 25 in FIG. 2 denote seals.

Next the operation mode of the fuel injection system with the above construction will be described. The fuel in the fuel tank 4 is pumped by the fuel pump 5 and delivered to the pressure control device 6. The pressurized fuel whose pressure is maintained at a constant level by the pressure control device 6 flows through the fuel line 7 into the fuel inlet 14 of the housing 11. The fuel flows from the fuel inlet 14 through the annular groove 14' and the radial hole 21 of the control member 13 into the fuel passage 20. When one of the radial communication slits 22 of the control member 13 and the distribution slot 18 of the rotor 12 overlap each other, the fuel flows from the fuel passage 20 through the radial slit 22, the distribution slot 18, the arcuate groove 15', the fuel outlet 15 and the fuel line to the fuel injection valve 8, which injects the delivered fuel into the intake passage of its associated cylinder of the engine 1.

Since the rotor 12 makes one rotation for every one cycle of the engine 1 and because the control member 13 is provided with the four radial communication slits 22 and the housing 11 is provided with the four fuel outlets 15, the fuel is delivered to each fuel outlet 15 once for every one cycle of the engine 1. Therefore the fuel is delivered to each fuel injection valve 8 once for every one cycle of the engine 1. In case of the four cycle engine, two rotations of the crankshaft of the engine 1 correspond to one cycle (In case of the two cycle internal combustion engines, one rotation of the crankshaft corresponds to one cycle so that the rotor 12 must be so arranged as to make one rotation for every one rotation of the crankshaft.), so that the fuel is injected into the cylinder during the desired stroke. That is, the fuel is injected into each cylinder intermittently.

Figure 4:
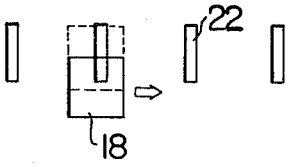
FIG. 4 is a schematic view illustrating the position of a fuel distribution slot with respect to communication slits of the first embodiment shown in FIG. 1.

The fuel metering and distribution through radial slits 22 and the distribution slot 18 by the rotation of the rotor 12 is schematically shown in FIG. 4. As the rotor 12 rotates, the distribution slot 18 displaced (rotated) in the direction indicated by the arrow to sequentially communicate or overlap with the radial slits 22 of the control member 13 (therefore, it communicates with the fuel outlets 15 of the housing 11) so that the fuel may be metered and distributed. The control member 13 is axially displaced in association with the intake air flow rate sensor 3 in response to the intake air flow rate so that the overlap area between the radial communication slit 22 and the distribution slot 18 changes. Therefore the fuel quantity delivered to the fuel injection valve 8 may be optimumly controlled in response to the intake air flow rate. More particularly, when the intake air flow rate is less, the distribution slot 18 is positioned with respect to the communication slit 22 as indicated by the solid line in FIG. 4, but when the flow rate increases, the distribution slot 18 is displaced relative to the radial slit 22 as indicated by the broken lines, whereby the fuel quantity to be delivered to the fuel injection valves may be increased.

In order to control the fuel quantity to be delivered to the fuel injection valves 8 with a higher degree of accuracy, it is preferable that the fuel flows continuously without being interrupted within the fuel metering-distribution device 10 regardless of the angular position of the rotor 12.

As described above, according to the present invention, the fuel metering and distribution can be effected by the single fuel metering-distribution device 10 which is very simple in construction, and the fuel metered with a higher accuracy can be intermittently injected by the fuel injection valve 8 into each cylinder of the engine.

In the first embodiment described above, the control shaft 13 provided with four radial communication slits 22 is axially slidably fitted into the rotor 12 provided with one distribution slot 18 whose angular width is larger than that of the radial slits 22, but various modifications of the arrangements of the rotor 12 and the control member 13 may be effected as will be described in detail hereinafter.

SECOND EMBODIMENT, FIGS. 5 AND 6

Figure 5:
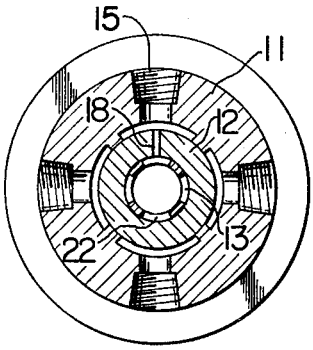
FIG. 5 is a sectional view of a second embodiment of the present invention.
Figure 6:
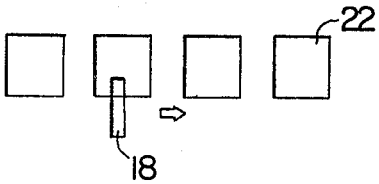
FIG. 6 is a view used for the explanation thereof.

In the second embodiment shown in FIGS. 5 and 6, the angular width of the distribution slot 18 is made smaller than that of the radial slits 22 of the control member 13 so that the fuel metering and distribution may be effected with a higher degree of accuracy.

THIRD EMBODIMENT, FIGS. 7, 8 AND 9

Figure 7:
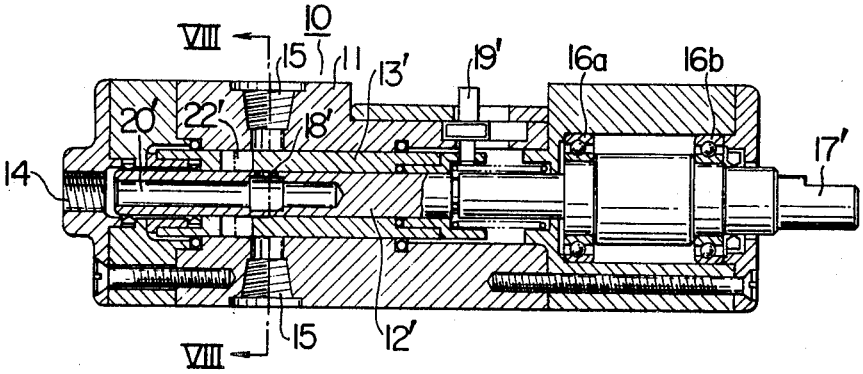
FIG. 7 is a sectional view along the line VII—VII of FIG. 8, which shows a third embodiment of the present invention, corresponding to FIG. 3.
Figure 8:
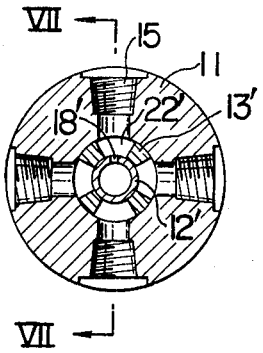
FIG. 8 is a sectional view taken along the line VIII—VIII of FIG. 7.
Figure 9:
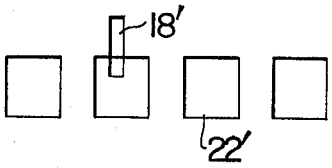
FIG. 9 is a view used for the explanation of the third embodiment and corresponding to FIG. 4.

In the third embodiment shown in FIGS. 7, 8 and 9, comparing with the first embodiment, the rotor 12' is rotatably fitted into the hollow cylindrical control member 13'. The rotor 12' is provided with the axial fuel passage 20' and the radial distribution slot 18', and the control member 13' is provided with four equiangularly spaced apart radial slits 22' whose anular width is greater than that of the radial distribution slot 18' of the rotor 12'. The rotor 12' is drivingly coupled through the connecting member 17' to the crankshaft of the engine in a manner substantially similar to that of the first embodiment. The control member 13' is operatively coupled through the connecting member 19' to the intake flow rate sensor 3.

The operation mode of the third embodiment is substantially similar to that of the first embodiment. That is, the radial distribution slot 18' of the rotor 12' sequentially overlaps with each of the radial slits 22' of the control member to distribute the fuel (see FIG. 9). The fuel metering is effected by the axial displacement of the control member 13' in the same manner as that of the first embodiment.

FOURTH EMBODIMENT, FIGS. 10 AND 11

Figure 10:
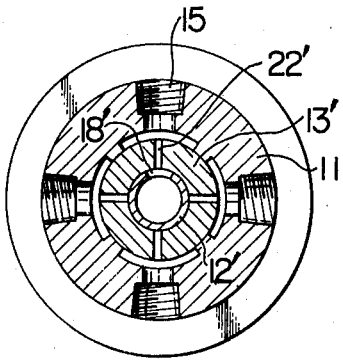
FIG. 10 is a view corresponding to FIG. 3 and illustrating only the essential portion of a fourth embodiment of the present invention.
Figure 11:
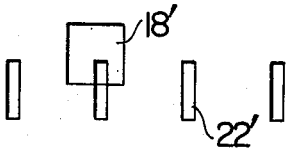
FIG. 11 is a view similar to FIG. 4 and used for the explanation of the fourth embodiment.

The fourth embodiment shown in FIGS. 10 and 11 is substantially similar in construction to the third embodiment except that the angular width of the distribution slot 18' is greater than that of the radial slits 22'.

SIXTH EMBODIMENT, FIGS. 14, 15 AND 16

Figure 15:
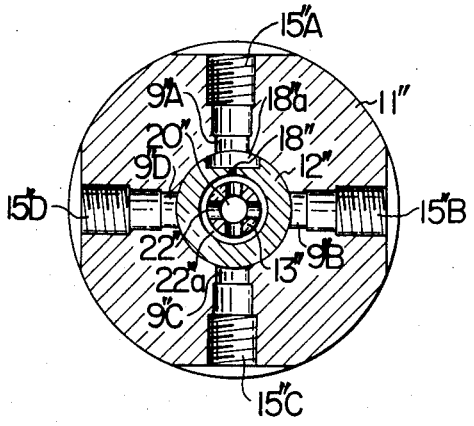
FIG. 15 is a sectional view taken along the line XV—XV of FIG. 14.

The sixth embodiment shown in FIGS. 14 and 15 is substantially similar in construction, except that the axial fuel passage 20'' of the control member 13'' is communicated through the four radial holes 22'' and an annular groove **22''*a* formed around the outer side surface of the control shaft with the radial distribution slot 18'' of the rotor 12''. The distribution slot 18'' is, therefore, always in communication with the annular groove 22''*a* filled with the fuel so that there is an advantage that the fuel may be continously supplied to the radial distribution slot 18'' when the rotor 12''** is rotated. As the result, the more accurate and smoother fuel distribution and metering may be ensured.

In the first to sixth embodiments, only one distribution slot 18, 18' or 18'' is provided because a larger manufacture tolerance may be allowed.

In the variation shown in FIG. 16 of the sixth embodiment, the rotor 12'' is provided with two radial distribution slot 18'' and 18'''so that the fuel may be charged into each cylinder twice for every one cycle.

As shown in FIG. 14, in the sixth embodiment, a coiled spring 68 is loaded between the rotor 12'' and the shaft member 17'' so that the rotor member 12'' may be biased to its normal operative position relative to the housing 11''. The left end of the rotor 12'' is provided with a flange which is interposed between bearings **66*a* and 66*b*, and the bearing 66*b* is securely kept in position by a ring 67. Thus the smooth rotation of the rotor 12''** may be ensured.

FIFTH EMBODIMENT, FIGS. 12 AND 13

In order to ensure more accurate metering of fuel, it is preferable that the pressure difference between the fuel downstream of the distribution slot of the rotor and the fuel upstream of the radial slits of the control shaft 13 is maintained constant so that the fuel metering may be controlled only by the overlapped area between the distribution slot 18 and the radial slits 22. It will be described in detail hereinafter with reference to FIGS. 12 and 13.

Figure 12:
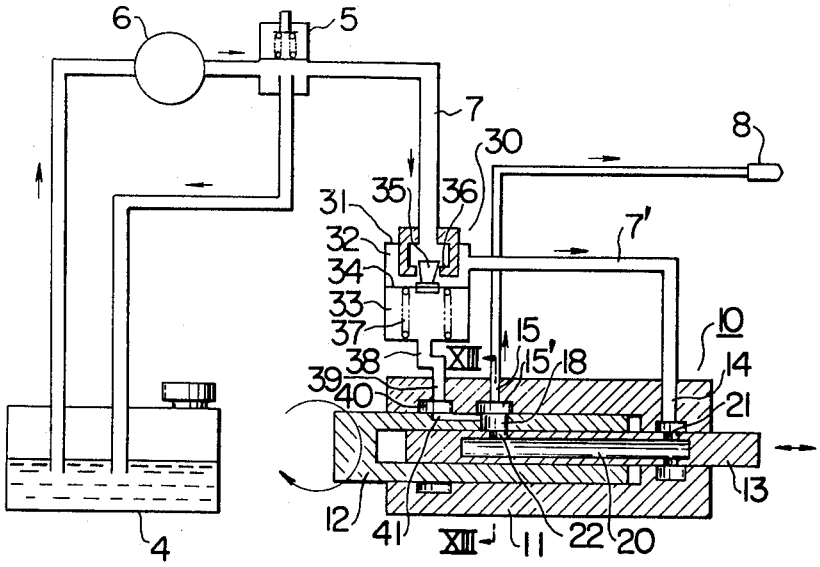
FIG. 12 is a schematic view of a fifth embodiment of the present invention.
Figure 13:
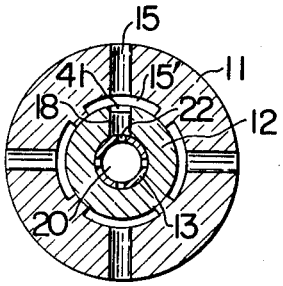
FIG. 13 is a sectional view taken along the line XIII—XIII of FIG. 12.

FIGS. 12 and 13 show the fifth embodiment of the present invention, which is substantially similar in construction to the first embodiment except a fuel pressure balancing arrangement to be described hereinafter. Reference numeral 30 denotes a differential pressure regulator for maintaining the pressure difference described above and comprising a housing 31, a diaphragm 34 dividing the housing 31 into an upstream chamber 32 and downstream chamber 33, a valve 35 disposed within the upstream chamber 32 and coupled to the diaphragms 34, a valve seat 36 upon which is seated the valve 35, and a coiled spring 37 disposed within the downstream chamber 33 for biasing the diaphragms 34. The upstream chamber 32 is communicated with not only the pressure regulator 5 through the fuel line 7 and the valve 35 but also with the fuel intake port 14 of the fuel metering-distribution device 10 through a fuel line 7'. The downstream chamber 33 is communicated through a fuel line 38 with an annular groove 40 formed in the inner wall of the housing 11, which is communicated through a radial fuel passage 39 formed through the side wall of the housing 11 with the fuel line 38. The annular groove 40 is communicated with the radial distribution slot 18 of the rotor 12 through an axial groove 41 formed in the outer side surface of the rotor. The pressure difference between the upstream chamber 32 and the downstream chamber 33 can be maintained within a predetermined range by the cooperation of the valve 35, the diaphragms 34 and the coiled spring 37. Therefore the difference in pressure between the fuel flowing into the slit 22 of the control member 13 and the fuel flowing out of the distribution slit 18 of the rotor may be maintained constant. As a result, the fuel metering can be controlled only by the overlapped area between the distribution slot 18 and the radial slit 22 so that, in response to the intake air flow rate, the optimum and accurately metered quantity of fuel may be charged into the cylinders or suitable portions in the intake manifold of the engine.

The above pressure balancing arrangement including the differential pressure regulator 30 may be applied to any of the embodiments described above.

As described above, according to the present invention, in response to the intake air flow rate, the fuel is metered with a higher degree of accuracy, and supplied to the fuel injection valves so that the intermittent fuel injections may be effected. The fuel injection system in accordance with the present invention is very simple in construction and is restricted to a minimum number of structual parts.

What we claim is:

1. A fuel injection system for an internal combustion engine having at least one cylinder comprising, a sensor for detecting the flow rate of intake air;

a fuel delivery device for delivering the fuel under a predetermined pressure;

a fuel metering device for metering the fuel delivered from said fuel device in association with said sensor; and at least one fuel injection nozzle for injecting the fuel delivered from said fuel metering device into the corresponding cylinder of the engine, said fuel injection system being characterized in that, said fuel metering device comprises, a. a housing with at least one fuel outlet communicated with said fuel injection nozzle;

b. a rotor rotatably fitted into said housing for rotation in synchronism with the rotation of the engine;

c. a control member fitted into said housing and engaging said rotor, said control member being operatively coupled to said sensor so as to be displaced in the axial direction relative to said rotor in response to the detecting operation of said sensor;

said rotor and said control member being provided with at least one slot and at least one slit, respectively, said at least one slot and said at least one slit being communicated with each other through an overlapped area between the former and the latter, said overlapped area being controlled by the relative movement between the rotor and the control member, the fuel being metered through said overlapped area, and said metered fuel being intermittently distributed to said outlet formed in said housing in response to the rotation of the rotor.

2. A fuel injection system as set forth in claim 1, wherein said internal combustion engine is of a multi-cylinder type;

each cylinder has at least one fuel injection nozzle;

said at least one fuel outlet formed in said housing and communicated respectively with their corresponding injection nozzle are equal in number to said cylinders of the engine, fuel is metered by means of the combination of said slit and slot which are respectively provided in said control member and said rotor, and said metered fuel is sequentially distributed, in response to the rotation of the rotor, to said fuel outlets of the housing.

3. A fuel injection system as set forth in claim 2 wherein one of said rotor and said control member is provided with a fuel passage communicated at one end with at least one slit provided therein and at the other end with said fuel delivery device continuously feeding the fuel under pressure thereto, said at least one slit or slot provided in the other one of said control member and said rotor, are so arranged as to be communicated with each outlet of said housing, and said fuel passage is communicated sequentially through said slit and slot provided in said control member and said rotor with each outlet of said housing in response to the rotation of the rotor.

4. A fuel injection system as set forth in claim 3 wherein said housing has a cylinder bore;

said each fuel outlet thereof being opened to said cylinder bore in the same axial position;

said rotor which is cylindrical, is rotatably fitted into said cylinder bore of said housing;

said fuel passage is formed and extend axially within said control member of a cylindrical shape which is fitted into said rotor in such a way that the axial displacement of said control member with respect to said rotor is permitted but the rotation with said rotor is not permitted;

said control member is so operatively coupled to said sensor that said control member may be axially displaced in association with said sensor;

said at least one slot provided in said rotor radially extends through the wall thereof in the substantially same axial position as that of one end of the fuel outlet which is opened to the cylinder bore of said housing, said slot having a predetermined axial and circumferential width; and said at least one slit provided in said control member extends through the wall thereof in the axial position in which said slit may be communicated with the slot of the rotor, said slit of said control member having a predetermined axial and circumferential width.

5. A fuel injection system as set forth in claim 4 wherein said fuel outlets of said housing are equiangularly spaced apart from each other in the circumferential direction of said cylinder bore; said rotor is provided with one slot;

the number of slits provided in said control member is equal to that of the cylinders of the engine;

each of said slit of the control member is in the substantially same circumferential position as that of one end of its associated fuel oulet which opens to the cylinder bore of the housing, said slit being equiangularly spaced apart from each other in the circumferential direction; and said rotor makes one rotation for every one cycle of the engine.

6. A fuel injection system as set forth in claim 5 wherein the circumferential width of each said slit of the control member is greater than that of said slot of said rotor.

7. A fuel injection system as set forth in claim 4 wherein said fuel outlets of said housing are equiangularly spaced apart from each other in the circumferential direction of said cylinder bore thereof;

said control member is provided with an annular groove, in the outer wall thereof, said annular groove being in communication with said slot of the rotor and with said fuel passage which communicates with the fuel delivery device;

fuel is metered through an overlapped area between said slot of the rotor and said annular groove, said overlapped area being controlled by the relative movement between the rotor and the control member; and said rotor makes one rotation for every one cycle of the engine.

8. A fuel injection system as set forth in claim 7 wherein said rotor is provided with one slot.

9. A fuel injection system as set forth in claim 7 wherein said rotor is provided with two radial slots located at the same axial position but circumferentially spaced apart from each other by 180°.

10. A fuel injection system as set forth in claim 3 wherein said housing is provided with a cylinder bore;

said fuel outlets of said housing are opened, at one end, to said cylinder bore in the same axial position;

said control member is cylindrical and is axially slidably fitted into said cylinder bore of said housing;

said rotor has a fuel passage extending axially, is cylindrical and is rotatably fitted into said control member;

said control member is operatively coupled to said intake air flow rate sensor so as to be displaced axially in response to the operation of said sensor;

said slits of said control member are equal in number to the cylinders of said engine, each of said slits of the control member is communicated with said each fuel outlet of said housing in the same axial position, and has a predetermined axial and circumferential widths and radially extends through the wall of said control member; and said slot of said rotor radially extends through the wall of said rotor in an axial position where said slot is communicated with said slits of said control member, said slot of said rotor having a predetermined axial and circumferential widths.

11. A fuel injection system as set forth in claim 10 wherein said fuel outlets of said housing are equiangularly spaced apart from each other in the circumferential direction of said cylinder bore;

said rotor is provided with one slot;

each of said slits of the control member is in the same circumferential position as that of one end of its associated fuel outlets which open to the cylinder bore of the housing, said slit being equiangularly spaced apart from each other in the circumferential direction; and said rotor makes one rotation for every one cycle of the engine.

12. A fuel injection system as set forth in claim 10 wherein the circumferential width of each of said slits of the control member is greater than that of said slot of the rotor.

13. A fuel injection system as set forth in claim 1 wherein said fuel metering device further comprises a differential pressure regulator for maintaining constant fuel pressure difference between the upstream and the downstream of the passage formed by said slits of the control member and said slot of the rotor.

14. A fuel injection system as set forth in claim 13 wherein said differential pressure regulator comprises a. a housing;

b. a diaphragm which defines an upstream chamber and a downstream chamber within said housing, the pressure of the fuel in the upstream of said passage being transmitted to said upstream chamber and the pressure of the fuel in the downstream thereof being transmitted to said downstream chamber; and c. a valve coupled to said diaphragm for displacement in unison therewith in response to the difference in pressure between said upstream and downstream chambers, thereby controlling the quantity of the fuel to be supplied from said delivery device of said fuel metering device.

* * * * *